US010821503B1

(12) United States Patent
Wang

(10) Patent No.: US 10,821,503 B1
(45) Date of Patent: Nov. 3, 2020

(54) SEMI-SOLID METAL IN-CAVITY MOLDING DIE

(71) Applicant: Shenghua Wang, Xiamen (CN)

(72) Inventor: Shenghua Wang, Xiamen (CN)

( * ) Notice: Subject to any disclaimer, the term of this patent is extended or adjusted under 35 U.S.C. 154(b) by 0 days.

(21) Appl. No.: 16/660,785

(22) Filed: Oct. 22, 2019

(30) Foreign Application Priority Data

Aug. 23, 2019 (CN) ..... 2019 1 0785253

(51) Int. Cl.
*B22D 17/00* (2006.01)
*B22D 17/30* (2006.01)

(52) U.S. Cl.
CPC ..... *B22D 17/007* (2013.01); *B22D 17/30* (2013.01)

(58) Field of Classification Search
CPC ..... B22D 17/007; B22D 17/30; B22D 17/22; B22D 17/2218; B22D 17/2272; B22D 17/229; B22D 17/2254; B22D 17/00; B22D 17/02; B22D 17/002; B22D 17/04; B22D 17/08; B22D 17/10; B22D 17/2061
See application file for complete search history.

(56) References Cited

FOREIGN PATENT DOCUMENTS

| | | |
|---|---|---|
| CN | 100531964 | 8/2009 |
| CN | 103817309 | 5/2016 |
| CN | 106955985 A * | 7/2017 |
| CN | 104338932 | 9/2017 |

OTHER PUBLICATIONS

English Machine Translation of CN-106955985-A (Year: 2017).*

* cited by examiner

*Primary Examiner* — Kevin P Kerns
*Assistant Examiner* — Steven S Ha
(74) *Attorney, Agent, or Firm* — JCIP Global Inc.

(57) ABSTRACT

A semi-solid metal in-cavity molding die includes a die body. The die body includes a male die and a female die, a cavity formed by the male die and the female die, a runner communicated with the cavity and a sprue communicated with the runner are provided inside the die body. An inner wall of the runner is provided with a plurality of guide protrusions which are arranged in a spiral track. The guide protrusions combine the inner wall of the runner to form a special-shaped pipeline for molten metal to flow through, and a cooling mechanism arranged around the runner is further provided in the die body.

8 Claims, 9 Drawing Sheets

SEMI-SOLID METAL IN-CAVITY MOLDING DIE

CROSS-REFERENCE TO RELATED APPLICATION

This application claims the priority benefit of China application serial no. 201910785253.7, filed on Aug. 23, 2019. The entirety of the above-mentioned patent application is hereby incorporated by reference herein and made a part of this specification.

BACKGROUND

Technical Field

The invention relates to the technical field of semi-solid metal molding, in particular to a semi-solid metal in-cavity molding die.

Description of Related Art

In the 1970s, professor M. C. Flemings of Massachusetts Institute of Technology discovered and developed the semi-solid metal molding technology to address the problem of defects such as gas pockets, shrinkage cavity and slag inclusion caused by turbulence during teeming and die casting. And after more than 40 years of research and development, the following preparation methods have been developed:

1. CRP (Continuous Rheo-Conversion Process). (WPI Corporation, USA);
2. NRP (New Rheocating Processing). (UBE Industries);
3. Double Shear Rheology (Brunel University, UK);
4. Mechanical Stirring. (Idra SSRTM);
5. Electromagnetic Stirring (ALumax, USA); and
6. SEED (Canada).

Specifically, the light metal semi-solid injection molding machine disclosed by the Chinese patent with a grant announcement No. CN104338932B includes a feeding device, a melting device, a stirring device, a conveying device and an injection device, wherein the front side of the feeding device is connected with the rear end of the melting device, the front end of the melting device is connected with the stirring device, the injection device is positioned below the melting device, the upper end of the conveying device is connected with the melting device, and the lower end of the conveying device is connected with the injection device.

According to the semi-solid metal casting equipment and the process thereof disclosed in the Chinese patent with the grant announcement No. CN103817309B, the process includes: 1) putting the metal into a melting furnace for heating and melting into liquid metal, 2) enabling the molten liquid metal in the melting furnace to gradually flow into a heat preservation furnace, 3) adjusting the electric casting valve to control the flow of the liquid metal flowing into the stirring cooling tank from the heat preservation furnace, 4) measuring the temperature of the liquid metal in each section of the stirring cooling tank through an infrared temperature sensor, 5) powering on a mixer and a reciprocating mechanism, so that an output gear of a gear reduction motor drives a hollow rotating shaft to rotate through a driven gear, thereby driving a metal sleeve and an outer-corrugated high-temperature-resistant ceramic sheath to rotate in the flowing liquid metal, wherein the reciprocating mechanism drives a trolley to do reciprocating motion on a track so as to drive the ceramic sheath to transversely move in the stirring cooling tank while rotating inside the liquid metal in the stirring cooling tank, and measuring solidification degree of the liquid metal by vibration disk viscometer, and 6) pressing the semi-solid metal into a die body by a piston pump or a screw extrusion pump.

According to the semi-solid metal slurry preparing and forming equipment and method disclosed in the Chinese patent with the grant announcement No. CN100531964C, in the technology, a metal melt (containing certain suitable amount of aluminum alloy, magnesium alloy and the like), driven by a delivery pump, enters a slurrying machine of the device, and a heater and a cooler are arranged outside the slurrying machine; when the metal melt passes through the slurrying chamber of the slurrying machine, the metal melt is subjected to strong stirring and shearing action to form semi-solid slurry; and at the tail end of the slurrying chamber, the slurry is injected into a pressing chamber of a die casting machine through a discharge port, and when the volume of the slurry reaches a set amount, the slurry is pressed and injected into a die body by a punch and solidified and formed, so that semi-solid rheological molding of the metal is realized.

In the prior art, similar to each of the above-mentioned technologies, each of the above-mentioned methods requires a special stirring structure to generate frictional shearing force inside the alloy melt, the shearing force of the alloy melt is utilized to promote the fracture of dendrite arms, to reduce the grain size, to spheroidize the grains, and to finally form semi-solid metal melt. However, the existing semi-solid metal slurrying machines have the disadvantages of expensive investment, parts in contact with the metal solution prone to damages and accordingly high maintenance costs, which greatly hinder the popularization and application of the technology.

SUMMARY

To address the technical problems in the prior art, it's an object of the invention to provide a semi-solid metal in-cavity molding die which has the advantage of reducing the investment costs of the semi-solid metal melt molding technology.

In order to achieve the above object, the invention provides the following technical solution. A semi-solid metal in-cavity molding die includes a die body, wherein the die body comprises a male die and a female die, provided inside the die body are a cavity formed by the male die and the female die, a runner communicated with the cavity and a sprue communicated with the runner, and an inner wall of the runner is provided with a plurality of guide protrusions arranged in a spiral track, guide protrusions and the inner wall of the runner form a special-shaped pipeline for molten metal to flow through, and a cooling mechanism arranged around the runner is further provided in the die body.

According to the above technical solution, the molten metal is pressed and injected into the die body by using the existing pressure injection equipment, in this process, the molten metal firstly flows into the runner through the sprue, and finally enters the cavity through the runner; wherein the runner is configured as a special-shaped pipeline structure, so that when the molten metal, pushed into the runner by the pressure injection equipment, flows in the runner, the molten metal flow may change direction due to the obstruction of the guide protrusion; and the dual influences of the pushing force of the pressure injection device and the friction of the inner wall of the runner may result in a non-uniform flow rate of the molten metal at each bend in the runner, various flow states such as laminar flow, excessive flow, turbulent flow and the like are generated, so that frictional shearing force is generated inside the alloy melt and promotes the fracture of dendrite arms, reducing the grain size and spheroidizes the grains; meanwhile, semi-solid metal melt is generated under the temperature control of the cooling mechanism, and the semi-solid metal melt generated in the runner can enter a cavity in the die body under the action of subsequent metal melt thrust, thus finally, casting molding is finished; according to the above solution, it's not necessary to form the semi-solid metal melt in advance, namely a stirring mechanism is not required in the forming of the semi-solid metal melt, the molten metal can be directly used on a die casting machine after being produced, by doing so, the intermediate transfer process is reduced, the intermediate transfer devices can be reduced, adverse factors such as oxidation problems and the like in the transfer process can be minimized as much as possible, the casting process can be shortened, and the slurrying and molding time can be reduced, which renders an improved production efficiency, greatly reduced molding costs of the semi-solid metal melt, and therefore can effectively popularize the semi-solid metal molding technology.

The invention is further configured such that multiple runners are provided, and two ends of each of the runners are respectively communicated with the sprue and the cavity.

According to the above technical solution, on the premise of the same unit of molten metal flow, multiple runners have a reduced cross section area than a single runner, but have an increased surface area of the inner wall, so that the contact area of the molten metal and the runner can be greatly increased, the shearing friction force when the molten metal flows in the runner is effectively improved, and the molding effect of generating more semi-solid metal melt is finally achieved.

The invention is further configured such that a confluence cavity communicated with the cavity is provided in the die body, and two ends of each of the runners are respectively communicated with the sprue and the confluence cavity.

According to the above technical solution, the semi-solid metal melts formed in the runners can be converged again through the converging cavity, so that when multiple cavities exist in the same die body, the confluence cavity can redistribute the semi-solid metal melts to ensure that each of the cavities can be filled with semi-solid metal melt.

The invention is further configured such that the runners are arranged side by side, and the number of the runners is not less than two.

According to the above technical solution, each of the runners can be split in half and can be respectively positioned on the male die and the female die, so that each of the runners can be simply formed when the male die and the female die are combined.

The invention is further configured such that the runners are arranged at equal intervals circumferentially around one straight line, and the number of the runners is not less than three.

According to the above technical solution, the multiple runners which are spirally arranged can be prevented from being excessively dispersed, so that the cooling mechanism can conduct centralized cooling for each of the runners which are spirally arranged.

The invention is further configured such that the cooling mechanism is a spiral channel around each of the runners, and two ends of the cooling mechanism are communicated with an external cooling water circulation conveying device.

According to the above technical solution, cooling water is injected into the spiral channel at high pressure through the external cooling water circulation conveying device, and the cooling water is used for exchanging heat with the molten metal in the runner, so that the effects of cooling the molten metal and promoting the forming of semi-solid metal melt are achieved.

The invention is further configured such that a plurality of lines are provided in the inner wall of each runner, and each of the lines is circumferentially arranged along the inner wall of the runner or arranged as a thread line along the inner wall of the runner.

According to the above technical solution, when the molten metal flows in the runner, the molten metal is in contact with the lines and shearing friction force is generated, so that when the molten metal flows in the runner, centripetal rotary-cutting stirring happens, and grains are semi-solidified.

The invention is further configured such that a runner component is detachably mounted in the die body, and each of the runners is included in the runner component.

According to the above technical solution, after the casting is cooled and formed, a worker can take the casting and the runner component out of the die body together, so that the worker can conveniently cut off and separate the casting and the waste in the runner, and the waste in the runner can also be taken out by disassembling the runner component or directly heating and melting.

Compared with the prior art, the invention has the following beneficial effects.

It's not necessary to manufacture expensive special slurrying equipment, equipment maintenance costs are reduced, investment costs required by the semi-solid metal molding technology are greatly reduced, and development of the semi-solid metal molding technology can be promoted.

The production process does not require complex transfer procedures for the molten metal, so that the production efficiency is effectively improved, and the effect of improving the product competitiveness is achieved.

In the production process, too much contact between the molten metal and air outside can be avoided, so that gas pockets and slag inclusion caused by hydrogen absorption of the casting are greatly reduced, and the product quality is effectively improved.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

The present invention will now be described in detail with reference to the accompanying drawings and examples.

Figure 1:
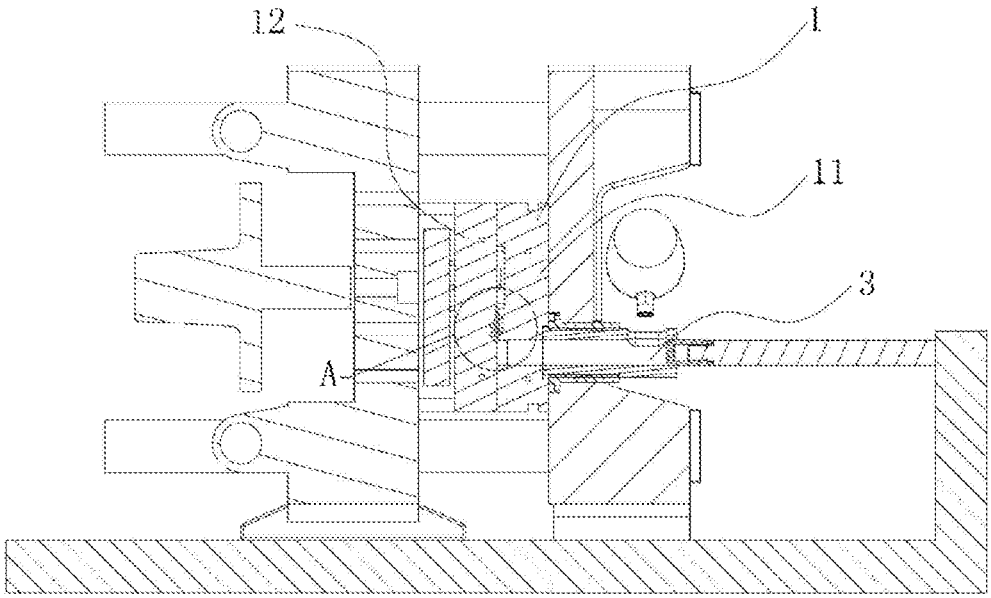
FIG. 1 is a schematic view showing a use state of Example 1.
Figure 2:
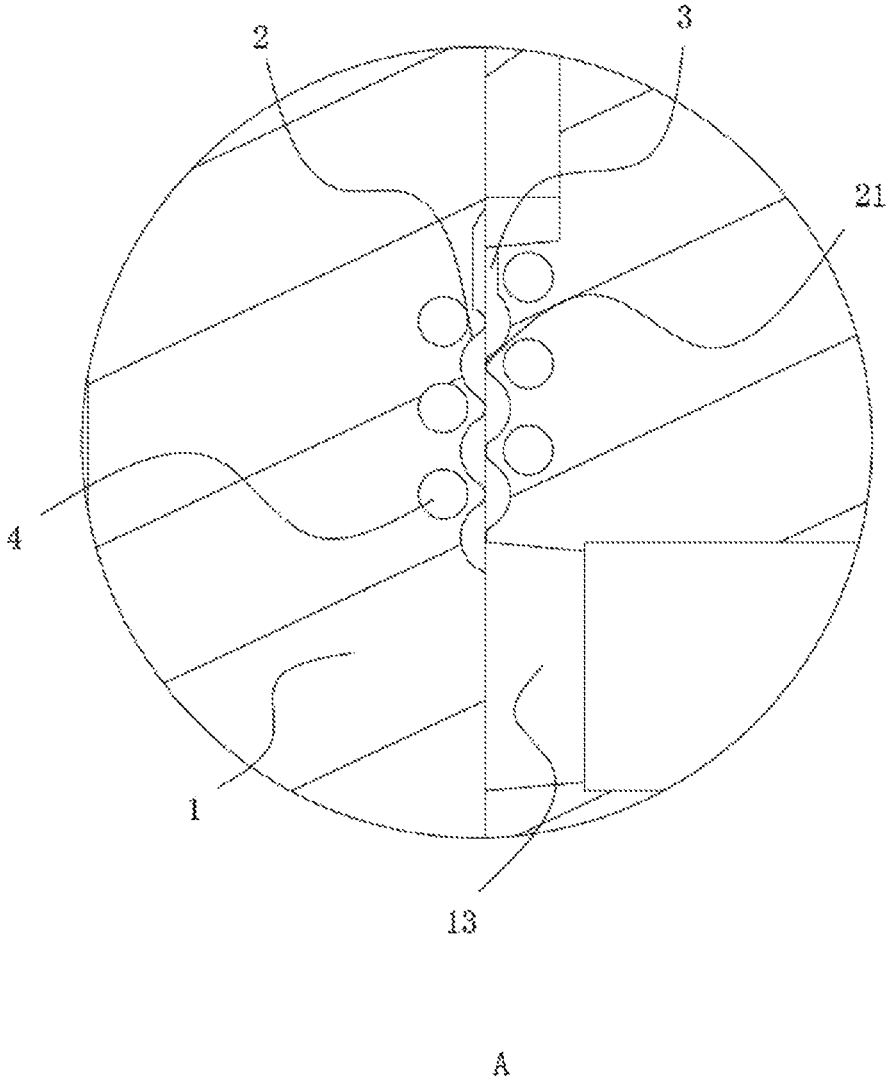
FIG. 2 is an enlarged view of the portion A of FIG. 1.

Example 1 a semi-solid metal in-cavity molding die, as shown in FIGS. 1 and 2, comprises a die body 1, and inside the die body 1, provided are a cavity 14 used for molding a casting 5, a sprue 13 communicated with a discharge port of an external pressure injection device and used for receiving molten metal, multiple runners 2 arranged side by side with two ends of each respectively molded with the sprue 13 and the cavity 14 for molding a semi-solid metal melt, and a cooling mechanism 4 arranged around each runner 2; wherein the die body 1 includes a female die 12 fixedly mounted on a die casting machine and a male die 11 movably connected to the die casting machine.

Figure 3:
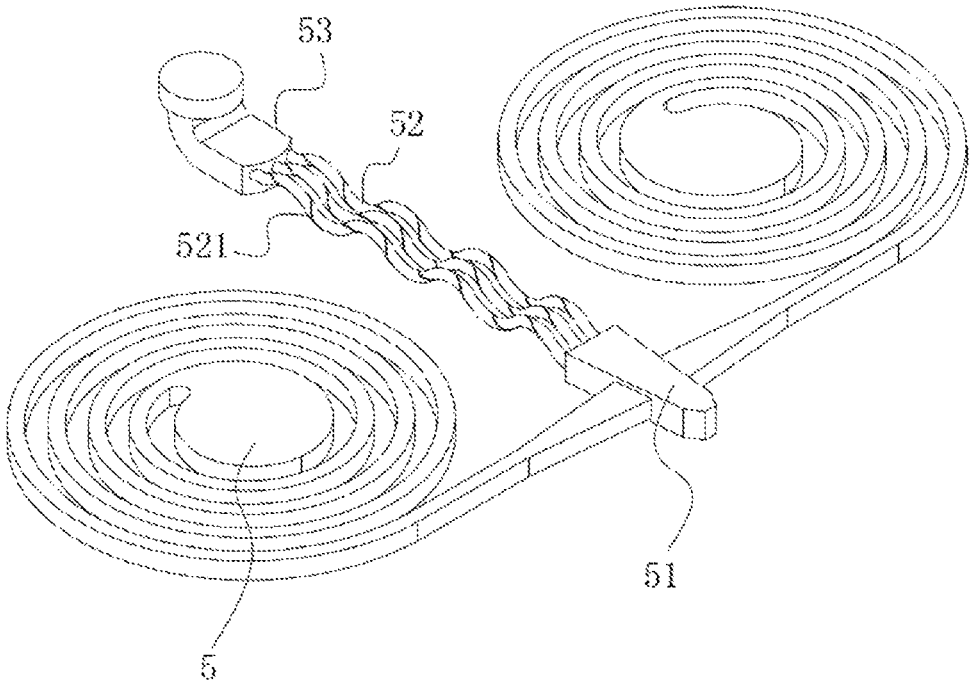
FIG. 3 is a schematic view showing the shape of the waste material at each part of Example 1.

As shown in FIGS. 2 and 3, runners 2 are arranged side by side, and the number of the runners is not less than two (the drawings of the present description specifically disclose an arrangement where the number of the runners is three), and a plurality of guide protrusions 21 are arranged in a spiral track on the inner wall of each runner 2.

Specifically, as shown in FIGS. 2 and 3, guide protrusions 21 in one runner 2 is arranged on two randomly arranged symmetrical surfaces of the runner 2, moreover, guide protrusions 21 are arranged in a staggered manner along the length direction of the runner, such that a special-shaped pipeline featuring a wave shape is formed by the inner wall of the runner 2 and guide protrusions 21 (wave crests and wave troughs of the wave line are connected with the thread line), the cross section of the special-shaped pipeline can be in a rectangular shape or in a circular shape, and this Example specifically discloses a structural schematic diagram showing the cross section in a circular shape.

As shown in FIG. 2, a confluence cavity 3 communicated with one end, far away from the sprue 13, of each runner 2 is further provided in the die body 1, and one end, far away from the runner 2, of the confluence cavity 3 is necked; further, the cavity 14 in the die body 1 may be provided with a plurality of passages, each of which is provided in communication with the confluence chamber 3. As shown in FIG. 3, when the semi-solid metal melt is completely cooled and formed, the casting 5, a confluence chamber waste 51, a runner waste 52 and a sprue waste 53 filled in the cavity 14, the confluence chamber 3, the runner 2 and the sprue 13, respectively, are formed in the die body 1, and the casting 5, the confluence chamber waste 51, the runner waste 52 and the sprue waste 53 are formed in the same shape and size as the cavity 14, the confluence chamber 3, the runner 2 and the sprue 13.

As shown in FIGS. 1 and 2, the cooling mechanism 4 is provided as a spiral channel, two ends of which are respectively communicated with the water inlet port and the water outlet port of the external condensed water circulation conveying device outside the die body 1, and the spiral channel is disposed around each runner 2, the water inlet port of the spiral channel is close to the sprue 13, and the water outlet port of the spiral channel is close to the confluence cavity 3; the spiral channel are divided into a plurality of sections that are arranged on the male die 12 and the female die 11 at intervals, and when the male die 12 and the female die 11 are combined, all the sections reach communication.

Figure 4:
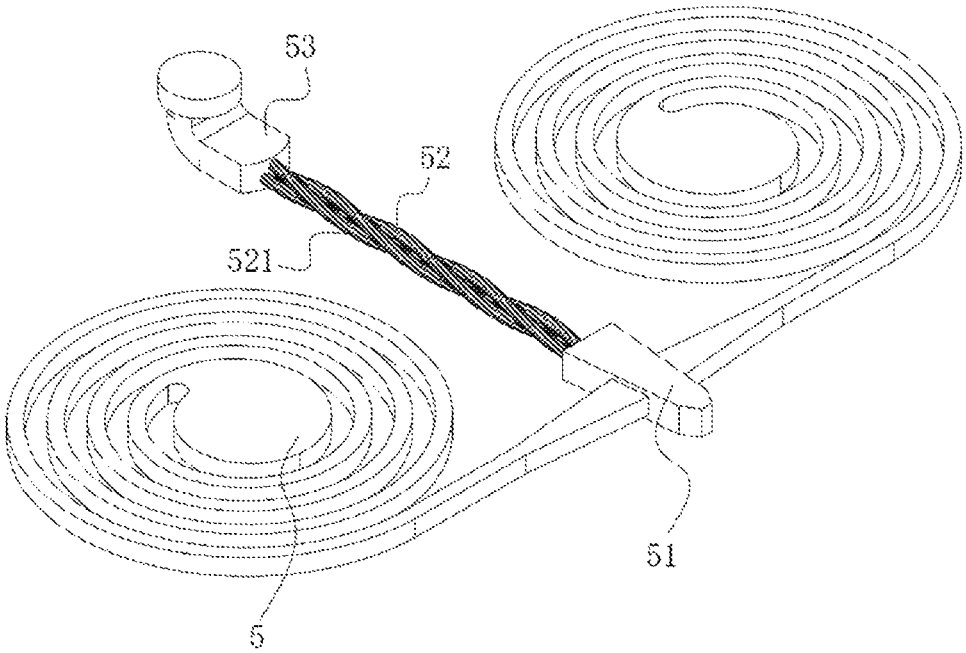
FIG. 4 is a schematic view showing the shape of the waste material at each part of Example 2.

Example 2 the present example differs from Example 1 in that each runner 2 is arranged at equal intervals circumferentially around one central line, and the number of runners 2 is not less than three, and in one runner 2, guide protrusions 21 are arranged in a spiral track along the inner wall of the runner, with at least three guide protrusions 21 distributed in one circle of the spiral track, in this manner, a special-shaped pipeline arranged spirally is formed by the runner 2 and guide protrusions 21; and further, runners 2 can be spirally arranged around one central line (particularly, waste formed when the runner is in a spiral special-shaped pipeline shape and runners are spirally arranged around one central line is disclosed in FIG. 4), as shown in FIG. 4, according to the above solution, after the semi-solid metal melt is completely cooled and formed, the casting 5, the confluence chamber waste 51, the runner waste 52 and the sprue waste 53 which are the same in shape and size as the cavity 14, the confluence chamber 3, the runner 2 (spirally arranged) and the sprue 13 respectively are formed in the die body 1; compared with Example 1, the spirally arranged runner 2 has a larger inner wall surface area than a wavy runner 2, the semi-solidification effect of the molten metal is better, but it's difficult to take out the formed waste material.

Furthermore, lines 22 are provided in the inner wall of each runner 2 and are arranged along the length direction of the runner 2 at equal intervals circumferentially along the inner wall. As shown in FIG. 3, according to the improved solution, waste lines 521 spirally arranged around the length direction of the runner waste 52 are formed on the runner waste 52; wherein each of the lines 22 may also be spirally arranged along the length direction of the runner 2, and as shown in FIG. 4, according to the improved solution, waste lines 521 spirally arranged around the length direction of the runner waste 52 are formed on the runner waste 52. When the molten metal flows in the runner 2, the effect of increasing the contact area between the molten metal and the inner wall of the runner 2 because of the lines 22 will be achieved, so that shearing friction force is more likely to generate to form a semi-solid metal melt, and when the semi-solid metal melt is solidified, the semi-solid metal melt in the runner 2 fills the lines 22 to form waste lines 521, and the shape of the waste lines 521 will be formed the same as the lines 22 provided in the inner wall of the runner 2.

Figure 5:
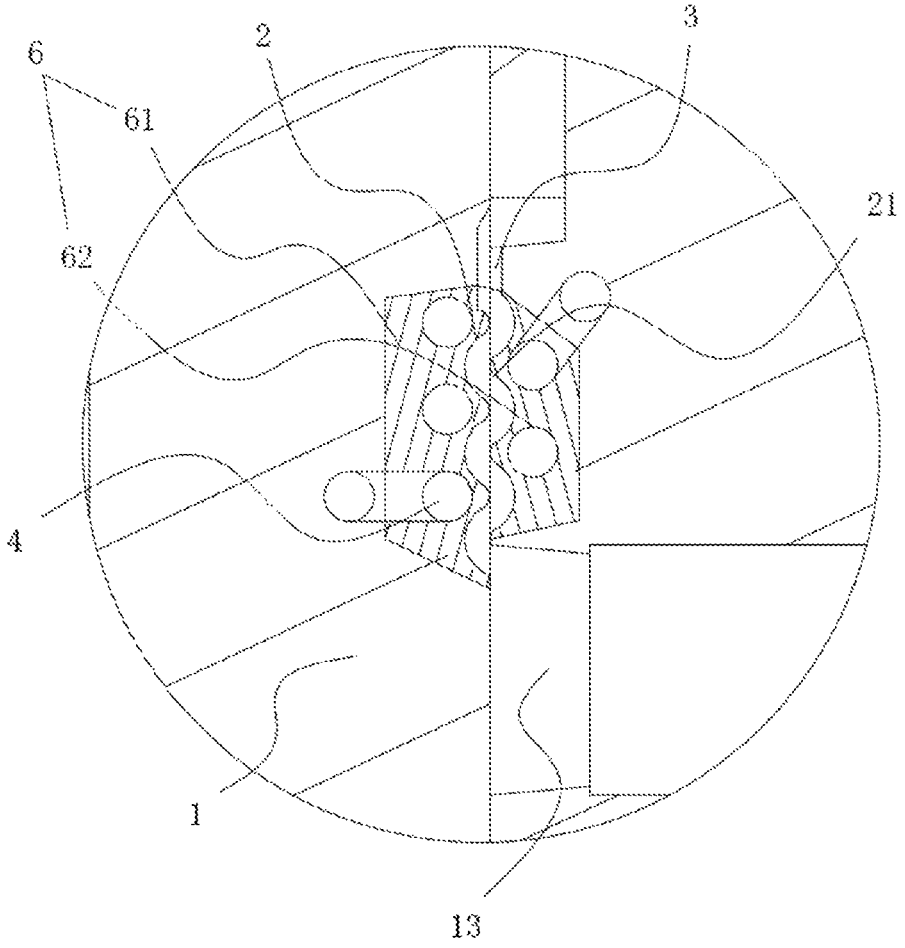
FIG. 5 is a schematic view showing the mounting position of the runner component improved by Example 1.
Figure 6:
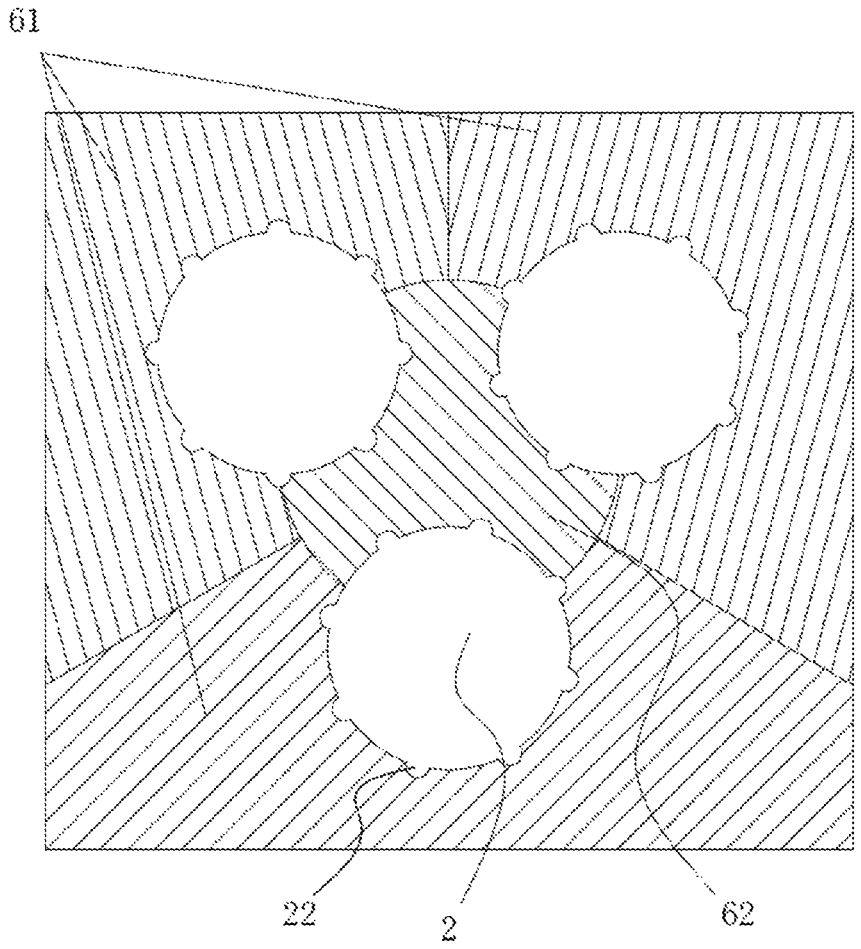
FIG. 6 is a schematic view showing the mounting position of the runner component improved by Example 2.

Furthermore, as shown in FIGS. 5 and 6, a runner component 6 is provided in the die body 1, each runner 2 is included in the runner component 6, and the runner component 6 is detachably mounted in the die body 1 by means of magnetic fixing, bolt locking, clamping fixing and the like; specifically, the runner component 6 includes a male core 61 and a female core 62, a plurality of curved grooves which are mutually matched to form the runner 2 are formed on the mutually matched surfaces of the male core 61 and the female core 62, and the number of the male cores 61 can be set according to the curved track of the runner 2.

Part of the cooling mechanism 4 can be arranged in the runner component 6, in this manner, the two ends of the cooling mechanism 4 are located in the die body 1, and when the runner component 6 is mounted in the die body 1, the part of the cooling mechanism 4 in the runner component 6 are communicated with the part in the die body 1 to form the complete cooling mechanism 4.

Figure 7:
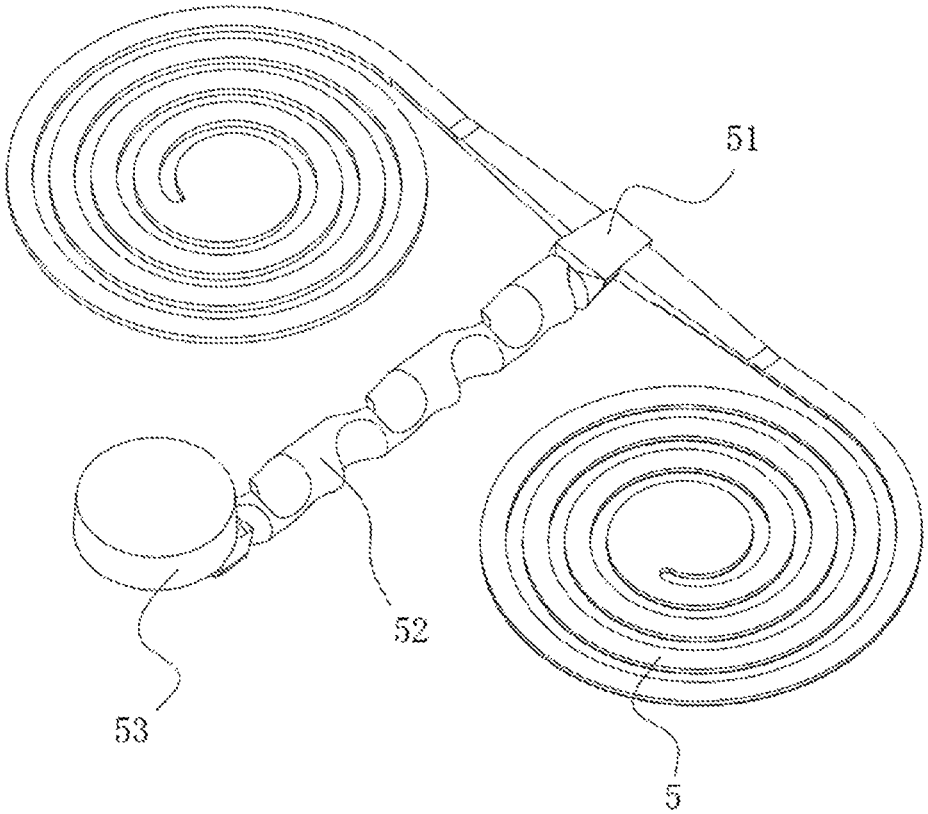
FIG. 7 is a schematic view showing the shape of the waste material at each part of Example 3.
Figure 8:
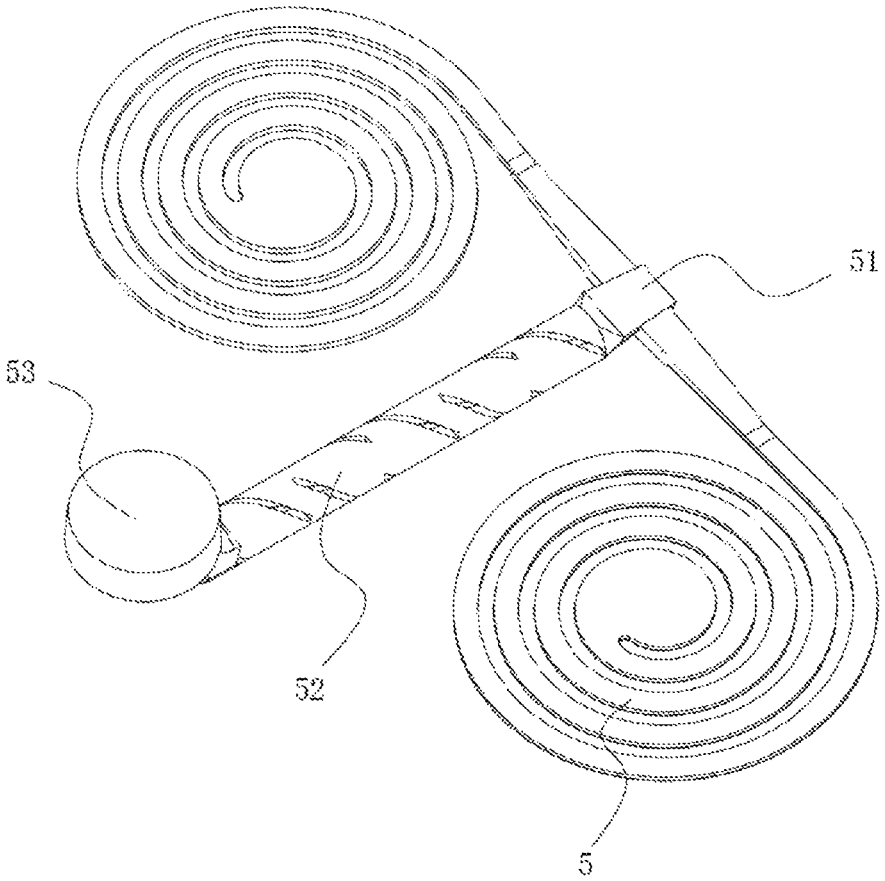
FIG. 8 is a schematic view showing the shape of the waste material at each part of Example 4.
Figure 9:
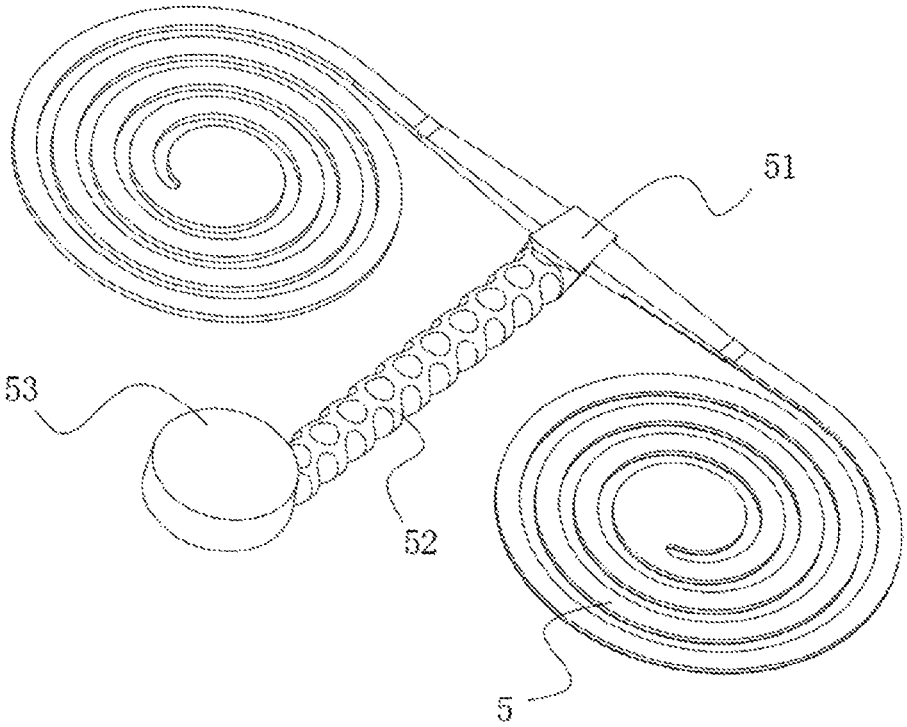
FIG. 9 is a schematic view showing the shape of the waste material at each part of Example 5.

Furthermore, the guide protrusions 21 can also be arranged in a double-spiral track shape, specifically, by utilizing the matching relationship between the positions and the shapes of the guide protrusions 21, the inner wall of the runner 2 and the guide protrusions 21 can form other special-shaped pipeline structures capable of enabling molten metal to generate laminar flow, excessive flow, turbulence and the like; the major characteristics lie in a plurality of guide protrusions 21 arranged on the inner wall of the runner 2 for changing the flow direction and the flow velocity of each part of the molten metal solution when the guide protrusions 21 are in contact with the molten metal solution, so that shearing friction force is generated inside the molten metal solution, and the molten metal solution can be semi-solidified with the cooling mechanism 4. Specifically, the special-shaped pipeline can be a structure having multiple sections crossed with each other to form a X-shape connection or in a left-and-right cross spiral mode; in this technical solution, the casting 5, the confluence chamber waste 51, the runner waste 52 and the sprue waste 53 after the semi-solid metal melt is cooled and formed are can be taken out of the die body 1; FIGS. 7, 8 and 9 show the shape of the waste material formed by adopting the special-shaped pipe structures with different shapes, the waste is the same as the runner 2 in shape, size and number.

A semi-solid metal molding process utilizing the above die body, comprising the steps of:

step 1, setting a teeming temperature according to different material components and the size and structure of a casting 5, and controlling the teeming temperature between high-limits of tolerances plus 20° C.–40° C. of the liquid temperature and the solid temperature of the alloy material, for example, the liquid temperature of the A356 aluminum alloy being 615° C., and then the teeming temperature being 635° C.-655° C.;

step 2, pushing the molten metal solution to a position close to the sprue 13 of the die body 1 through the pressure injection device at a low speed (i.e. the lowest pushing speed of the pressure injection device, typically 2 M/SEC), observing the surface and the molding condition of the casting 5, gradually increasing the speed, and then switching to high-speed injection (i.e. the highest pushing speed of the pressure injection device, typically 10 M/SEC), and finally pressurizing and injecting after the cavity 14 is filled with the semi-solid melt; and step 3, injecting cooling water into the spiral channel through an external condensed water circulation conveying device adopting a high-pressure adjustable flow rate water conveying mode to rapidly cool the runner 2 until the runner 2 is reduced to an ideal temperature (the temperature of the metal melt is an intermediate value of the sum of the liquid temperature and the solid temperature) so as to ensure that the liquid-solid ratio of each die is 50:50.

It should be noted that in the process of die casting, a heat preservation barrel should be used as the die casting material barrel to reduce the heat loss; in addition, in the die casting process, the temperature of the die body 1 should be kept at 200-250° C. so as to avoid the defects of streaks, interlayers and the like.

The working mechanism of the invention is as follows.

When the molten metal, pushed into the runner 2 by the pressure injection equipment, flows in the runner 2, the molten metal flow may experience spiral centripetal friction in the runner 2, which, in combination with the dual influences of the pushing force of the pressure injection device and the friction of the inner wall of the runner 2, may result in a non-uniform flow rate of the molten metal at each bend in the runner 2, various flow states such as laminar flow, excessive flow, turbulent flow and the like are generated, so that frictional shearing force is generated inside the alloy melt and promotes the fracture of dendrite arms, reducing the grain size and spheroidizes the grains; meanwhile, semi-solid metal melt is generated under the temperature control of the cooling mechanism 4, and the semi-solid metal melt generated in the runner 2 can enter a cavity 14 in the die body 1 under the action of subsequent metal melt thrust, thus finally, molding of the casting 5 is finished.

With the above technology adopted, it's not necessary to manufacture expensive slurrying equipment, so that the investment costs of the semi-solid metal molding technology can be reduced by ten thousand times compared with that of the prior art, and no influence factor of an oxide layer exists in the production process, the quality of the casting 5 will not be degraded due to cost reduction, on the contrary, the quality of the casting 5 can be further improved; in addition, in the pressure injection process, the raw materials are still molten metal, and the weight of the slurry is controllable, so that the amount of the residual waste in the runner 2 is controlled within an adjustable range; moreover, the casting process can be shortened, the slurrying and molding time can be shortened, the production efficiency can be effectively improved, and the costs can be further saved.

The special-shaped pipeline runner die body provided by Example 1 and the straight runner die body in the prior art were taken to conduct a simulation of flowability test for the experimental die, wherein the length-width ratio of one end, communicated with the cavity, of the straight runner was 1:1.2n-1.5n and n refers to the number of the special-shaped pipeline runners in the special-shaped pipeline runner flowability test, and the width of one end, communicated with the cavity, of the straight runner was the same as the inner diameter of the special-shaped pipeline runner in the special-shaped pipeline runner flowability test.

Specifically, the special-shaped pipeline runner was taken to conduct the simulation of flowability test for the experimental die, for example, the thrust of the pressure injection device was 13.2 MPA, the thickness of the casting was 2 mm, the actual weight was 52.4 g, the cross-sectional area of the special-shaped pipeline runner in a wavy shape was 82.93 mm2, the special-shaped pipeline runners were arranged in three rows, the linear distance between the two ends of the special-shaped pipeline runner was constantly 160 mm, and the distance between two adjacent wave crests of the special-shaped pipeline runner was 32 mm, and the distance between the adjacent wave crest and wave trough of the special-shaped pipe was 9 mm. It can be learned that the actual time to complete a die casting was 0.26548 s by using FLOW-3D simulation, and the total weight of the casting 5 and the returns in the runner was 460 g.

The straight runner is used for the simulation of flowability test for the experimental die. The thrust of the pressure injection device was 13.2 MPA, the thickness of the casting was 2 mm, the actual weight was 52.4 g, the cross-section area of one end, communicated with the cavity, of the runner was 333.36 $mm^2$, the cross-section area of one end communicated with the sprue was 541.84 mm2, the cross-sectional area of the straight runner was 437.6 $mm^2$, and the length of the straight runner was 160 mm. It can be obtained by FLOW-3D simulation that the actual die casting completion time was 0.27515, and the total weight of the casting 5 and the waste in the straight runner was 503 g.

It can be seen from the above-mentioned two simulation comparison structures that the material used in die casting by the semi-solid molding process is actually reduced by 43 g (runner returns) and the die casting time is shortened, and it can be seen from the simulation pictures that the metal flowability is better, with less slag inclusion and the gas inclusion.

The above-mentioned examples are merely preferred embodiments of the present invention, and the scope of the present invention is not limited to the above-mentioned embodiments, and all technical solutions falling within the spirit of the present invention fall within the scope of the present invention. It should be noted that those skilled in the art will appreciate that various modifications and adaptations can be made without departing from the spirit and scope of the present invention.

What is claimed is:

1. A semi-solid metal in-cavity molding die, comprising a die body, wherein the die body comprises a male die and a female die; provided inside the die body are a cavity formed by the male die and the female die, a runner communicated with the cavity and a sprue communicated with the runner, and an inner wall of the runner is provided with a plurality of guide protrusions arranged in a spiral track, the guide protrusions and the inner wall of the runner form a profiled pipeline for molten metal to flow through, and a cooling mechanism arranged around the runner is further provided in the die body.

2. The semi-solid metal in-cavity molding die according to claim 1, wherein the runner comprises multiple runners, and two ends of each of the runners are respectively communicated with the sprue and the cavity.

3. The semi-solid metal in-cavity molding die according to claim 2, wherein a confluence cavity communicated with the cavity is provided in the die body, and the two ends of each of the runners are respectively communicated with the sprue and the confluence cavity.

4. The semi-solid metal in-cavity molding die according to claim 2, wherein the runners are arranged side by side, and a number of the runners is not less than two.

5. The semi-solid metal in-cavity molding die according to claim 2, wherein the runners are arranged at equal intervals circumferentially around one straight line, and a number of the runners is not less than three.

6. The semi-solid metal in-cavity molding die according to claim 2, wherein the cooling mechanism is a spiral channel around each of the runners, and two ends of the cooling mechanism are communicated with an external cooling water circulation conveying device.

7. The semi-solid metal in-cavity molding die according to claim 2, wherein a plurality of lines are provided in the inner wall of each runner, and each of the lines is circumferentially arranged along the inner wall of the runner or arranged as a thread line along the inner wall of the runner.

8. The semi-solid metal in-cavity molding die according to claim 2, wherein a runner component is detachably mounted in the die body, and each of the runners is included in the runner component.

* * * * *